US005514234A

United States Patent [19]

Plaschy et al.

[11] Patent Number: 5,514,234

[45] Date of Patent: May 7, 1996

[54] METHOD AND DEVICE FOR FIXING THE ENDS OF A YARN LAYER WOUND IN AN ORDERED MANNER ON A BEAM

[75] Inventors: Martin Plaschy, Hombrechtikon; Felix Walser, Stäfa, both of Switzerland

[73] Assignee: Stäubli AG, Switzerland

[21] Appl. No.: 146,162

[22] PCT Filed: Mar. 10, 1993

[86] PCT No.: PCT/CH93/00063

§ 371 Date: Nov. 15, 1993

§ 102(e) Date: Nov. 15, 1993

[87] PCT Pub. No.: WO93/19233

PCT Pub. Date: Sep. 30, 1993

[30] Foreign Application Priority Data

Mar. 16, 1992 [CH] Switzerland ..... 832/92

[51] Int. Cl.[6] ..... B32B 31/00

[52] U.S. Cl. ..... 156/148; 156/161; 156/583.1; 28/201; 139/257

[58] Field of Search ..... 156/157, 158, 156/159, 162, 166, 304.1, 304.3, 304.6, 502, 583.1, 308.4, 88, 148, 161, 177; 28/201, 203.1, 209, 193, 190, 172.1; 66/84 A; 139/97, 257

[56] References Cited

U.S. PATENT DOCUMENTS

| | | | |
|---|---|---|---|
| 2,537,007 | 1/1951 | Abbott, Jr. | 28/209 X |
| 4,211,594 | 7/1980 | Freitag et al. | 156/157 X |
| 4,476,173 | 10/1984 | Bachmann et al. | 428/57 |
| 5,032,214 | 7/1991 | Kile | 156/502 |

FOREIGN PATENT DOCUMENTS

| | | |
|---|---|---|
| 4116194 | 11/1992 | Germany . |
| 3-113056 | 5/1991 | Japan . |
| 6616685 | 5/1968 | Netherlands . |
| 669303 | 3/1989 | Switzerland . |

*Primary Examiner*—James Engel
*Attorney, Agent, or Firm*—Burns, Doane, Swecker & Mathis

[57] ABSTRACT

At their free ends the yarns are straightened, clamped and welded with a film. Welding is performed with two welding bars to which is allocated a brush beam to tension the yarns. The welding bars are borne and/or guided by a frame to which the brush beam is also secured. The frame is fitted on a mobile chassis which also has a holder to take a roll of welding film. For use in weaving preparation works and in weaving works, especially in preparing the warp and in starting weaving.

23 Claims, 2 Drawing Sheets

Figure 1:
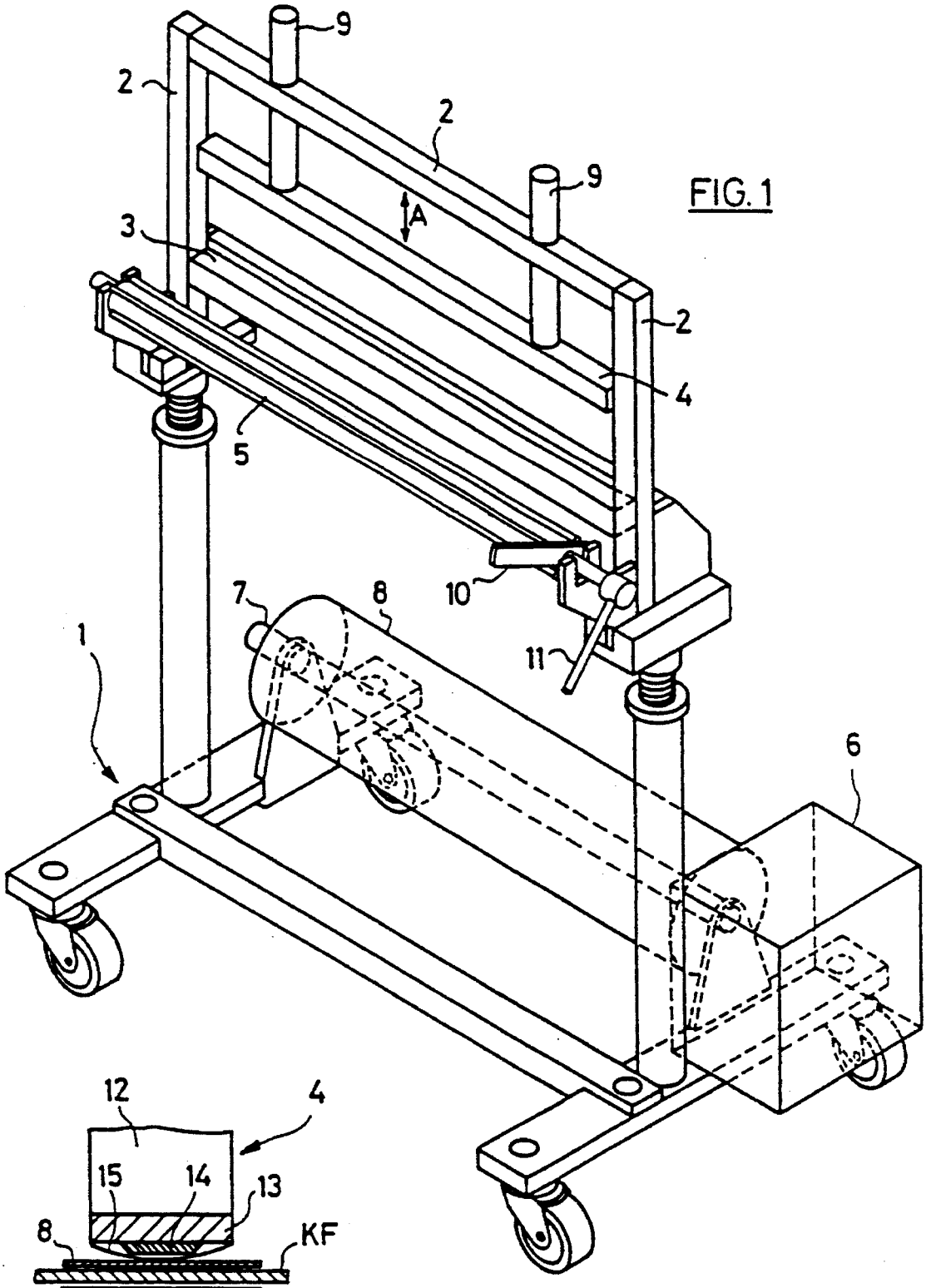

METHOD AND DEVICE FOR FIXING THE ENDS OF A YARN LAYER WOUND IN AN ORDERED MANNER ON A BEAM

The present invention relates to a method for fixing the ends of a yarn layer wound in an ordered manner on a beam, in which method the yarns are aligned, tensioned and fixed at their free ends.

Methods of this kind are employed in textile mills at various stages of the production process, for example in warping or sizing, during drawing in or knotting, or in weaving. The fixing takes place, as a rule, by means of a rail or a comb, this always necessitating an appreciable outlay for carrying out the fixing. Moreover, the rails or combs used for the fixing are, as a rule, relatively heavy and cumbersome, and they are therefore often abandoned and the fixing of the yarn ends is carried out by knotting or tying, although this makes handling more difficult in the next processing stage.

Now the invention is to provide a method of the type mentioned in the introduction, which can be employed simply, universally and quickly and which guarantees that the existing order of the yarn layer is maintained as effectively as possible.

This object is achieved, according to the invention, in that the fixing takes place by welding the yarns together with a foil.

In a method of this type, described in JP-A-113 056/1991, for preparing a warp for the start of weaving which is drawn into a harness, the warp yarns are adhesively bonded, by means of foils consisting of synthetic resin, together with a piece of fabric located in the weaving machine, said foils serving as an adhesive between the fabric and the warp yarns and a fabric tape covering their top side, so that a multi-layer construction is obtained.

This sandwich structure is relatively complicated to produce, and it proves a difficulty that the operation takes place directly on the weaving machine, that is to say where restricted conditions of space prevail. In this type of fixing, the tensions of the individual warp yarns are compensated relatively poorly, and therefore fabric of perfect quality is produced only approximately 100 to 150 cm after the bonding point. This leads to appreciable waste which, in addition to the relatively large amount of time required for the bonding operation and the lack of easy access for attendance, constitutes the principal disadvantage of this method.

Since no adhesive bonding together with a fabric is carried out in the method according to the invention, this method, when employed for preparing a drawn-in warp for the start of weaving, is not tied to the weaving machine, but can be carried out at any suitable point between the drawing-in machine and weaving machine. The preparation time for the start of weaving on the weaving machine itself is well below five minutes, for example around three minutes, because the welded portion has such small dimensions that it can be threaded in easily on the sand roll. Threading in on the sand roll is assisted by the rigidity of the foil. The result of this is that foil is substantially simpler to handle than a fabric strip. A further advantage to be mentioned in comparison with a fabric strip is the elasticity of the foil which allows a compensation of the yarn tension and which ensures that fabric of perfect quality is produced as early as 10 to 20 cm after the welding point.

The invention relates, furthermore, to a device for carrying out said method, with means for tensioning and with means for fixing the yarns. The device according to the invention is characterised in that the last mentioned means have two parallel welding bars which are adjustable relative to one another between a position of rest and a working position and which, in their position of rest, form a gap for the passage of the yarns and for receiving the foil.

Figure 2:
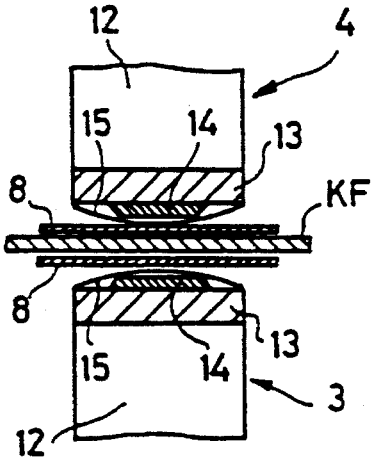
Figure 3:
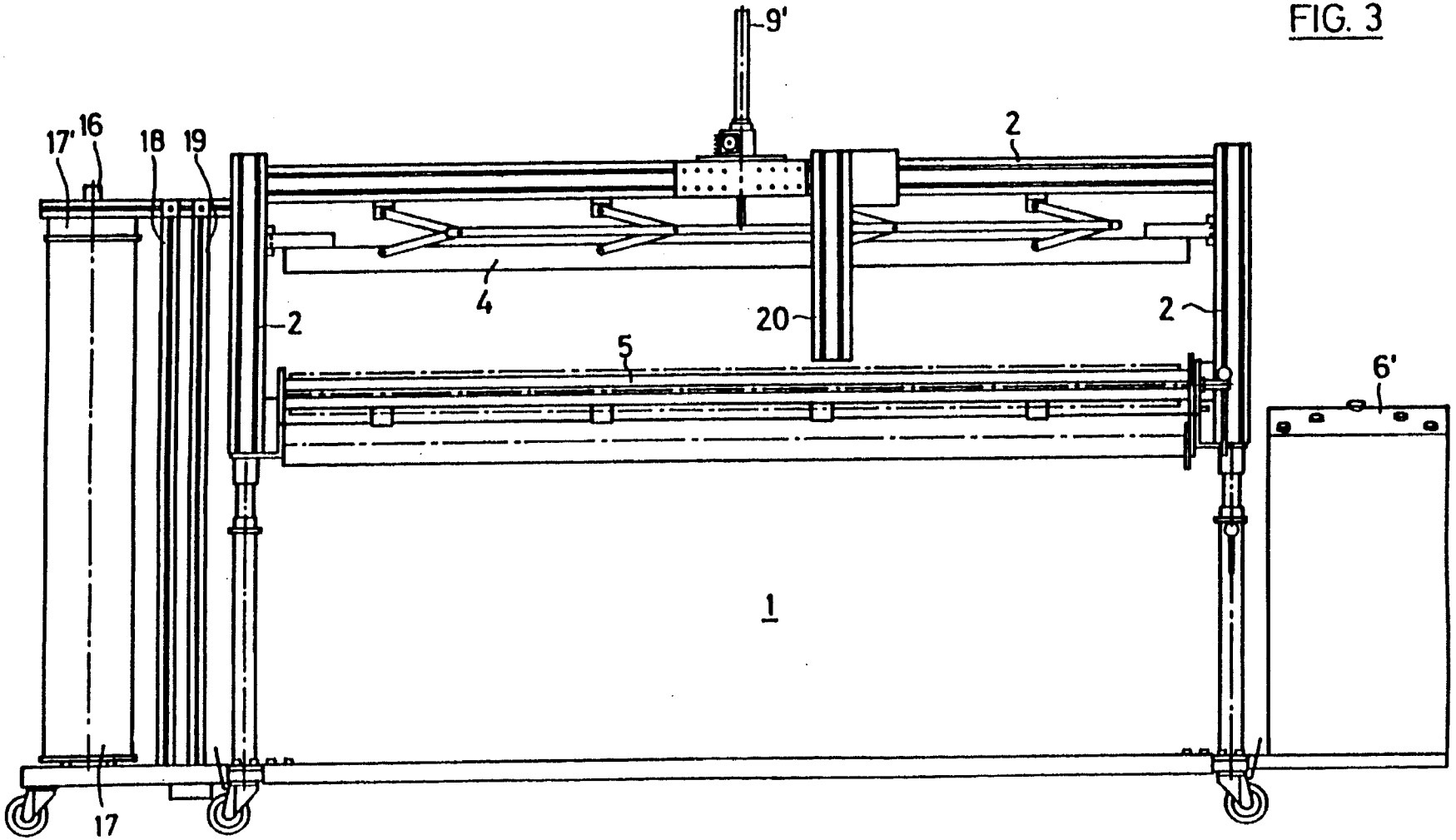

The invention is explained in more detail below by means of exemplary embodiments and the drawings; in these:

FIG. 1 shows a perspective representation of a device for preparing a warp for the start of weaving, FIG. 2 shows a detail of the device of FIG. 1; and FIG. 3 shows a front view of an alternative version of the device of FIG. 1.

Although a device for preparing a warp for the start of weaving which is drawn into a harness is described below, the invention is not restricted to this use, but can be employed in the entire pre-weaving apparatus wherever a beam having a yarn layer wound in an ordered manner on it, that is to say a pre-beam, a warping beam, a warping cylinder or a warp beam, is present. The following description describes all the essential steps of the method and an actual device for welding a warp together with a foil; it will be simple for an average person skilled in the art, by referring to this description, to transfer the device described to the requirements of other instances of use and adapt it to these.

According to FIG. 1, the warp-welding device according to the invention is mounted on a movable stand 1 and consists essentially of a frame 2 with a fixed lower welding bar 3 and with an upper welding bar 4 having a stroke adjustable in the direction of the arrow A in the frame 2, of a brush beam 5 connected to the frame 2, of a feed/control unit 6 with a control desk (not shown) connected to this, of a roller 7 having welding foil 8 and of a drive, symbolised by two cylinders 9, for the upper welding bar 4. Both the two welding bars 3 and 4 and the drive 9 are connected to the feed/control unit 6.

The stand 1 preferably consists of parts of the knotting stand used for the knotting machine in USTER TOPMATIC (USTER—registered trademark of Zellweger Uster AG), and the brush beam 5 is likewise known from this knotting stand and also from the drawing-in machine in USTER DELTA. The height of the frame 2 is adjustable and is selected so that the lower welding bar 3 is located somewhat below the plane of the yarn ends hanging from the weaving reed carried by the harness carriage or drawing-in carriage. Consequently, after the drawing in, the welding device can be moved directly up to the yarn ends. With regard to FIG. 1, therefore, the harness together with the drawn-in warp yarns would be located on the right behind the stand 1.

At the commencement of the welding operation, the welding foil 8 rolled up on the roller 7 and matched in width to the warp-yarn layer to be processed is drawn over the lower welding bar 3, is cut off in a width of a few, preferably approximately 4 cm by a suitable cutting device, such as is known, for example, for domestic foils, and is fixed to the ends of the lower welding bar 3 by means of quick-acting clamps. The warp yarns of the drawn-in warp are then drawn between the two welding bars 3 and 4, for example by means of a yarn clip, and are laid over the brush beam 5. By means of an anti-clockwise rotational movement of the latter caused by a lever 10, the warp yarns are tensioned uniformly. As soon as this is so, as a result of the actuation of a further lever 11 the brush beam 5 is lowered, the warp-yarn tension being maintained, until the warp yarns rest safely on the strip of welding foil 8 fixed to the lower welding bar 3.

Consequently, a piece of a greater length of, for example 0.8 to 1.2 meters is cut off from the welding foil 8, laid onto the warp-yarn layer and likewise fixed to the lower welding bar 3 by means of quick-acting clamps. The welding foil is then fastened in the region of its rear transverse edge to the welding bar 3 and hangs down over the brush beam 5 on the front side of the stand 1. This relatively long foil part serves for making easier the threading into the fabric-winding section of the weaving machine, in that it acts as a run-in part during the threading in and is drawn in from the sand roll.

The welding foil 8 is made of polyethylene and has a thickness of a maximum of 0.35 mm; it melts during the welding operation and thereby flows round the individual warp yarns. Practical tests have shown that this occurs under all conditions, even where very dense warps are concerned and even with two fabric plies.

After the longer foil piece has been fixed to the lower welding bar 3, the welding operation can be carried out. For this purpose, the upper welding bar 4, of which the distance from the lower welding bar 3 is approximately 20 cm or more in the position of rest, is moved downwards by means of its drive 9 and brought into a specific position relative to the lower welding bar 3 in which it presses against the latter. The adjustment travel of the upper welding bar 4 is determined by proximity switches (not shown) arranged on the frame 2. The lower welding bar 3 is resiliently mounted, so that, in the specific mutual position of the two welding bars, a specific pressure prevails between them.

As soon as the upper welding bar 4 has reached its working position, the two welding bars 3 and 4 are heated for a specific time to a specific temperature of approximately 80°–100° C., the welding intensity being determined by the duration of this heating. It has been shown, in practice, that this duration amounts at most to approximately 12 to 15 seconds. This time is adjustable at the control desk. When it has elapsed, the upper welding bar 4 remains in its working position for a few more seconds during the cooling phase and is then moved into its position of rest again, preferably automatically.

The end of the warp-yarn layer welded together with the foils 8 is then released, and the drawn-in warp, together with its warp yarns unclamped from the weaving reed, can be transported to the weaving machine or into an intermediate store. For the actual start of weaving on the weaving machine, it is necessary merely to thread in the sand roll the foil portion acting as a run-in part. This operation takes well below 5 minutes and, as a rule, no more than 3 minutes and therefore amounts to only a fraction of the approximately 20 minutes required for the conventional manual knotting of the warp yarns, knotted together in bunches, to a fabric residue.

According to FIG. 2 which shows a cross-section through the two welding bars 3 and 4 shortly before their working position is reached, each welding bar consists of a carrier 12 having a supporting layer 13 for a resistance wire 14 and of a covering foil 15 covering the resistance wire 14 relative to the outside. The two polyethylene foils 8 and the warp-yarn layer KF lying between the foils and to be welded together with these can be seen between the two welding bars 3 and 4.

The supporting layer 13 consists of glass-fibre-reinforced plastic, preferably polytetrafluoroethylene, and the covering foil 15, serving for preventing the foil 8 from bonding to the resistance wire 14, likewise consists of said polytetrafluoroethylene. The resistance wire 14, which, for example, consists of a tungsten alloy, is tensioned in the longitudinal direction and projects at its ends beyond the supporting layer 13, with the result that, during the welding, the foils 8 are not weakened in the region of their edge portions projecting in width beyond the warp-yarn layer. This is important in order to prevent the foils 8 from tearing laterally during the drawing into the weaving machine. To maintain a constant tension, the resistance wire 14 is exposed at its ends to an appropriate pull which is generated, for example, by means of levers which are under spring force.

There can be alternatives to the method described in that the warp yarns are fixed not by welding together with a foil, but by clamping, the warp-yarn layer being clamped by flat sectional rails, a plurality of transport bands which serve for threading into the weaving machine being fastened to the sectional rails or to one of these over the width of the warp layer. These transport bands, of which there are approximately four, are of belt-like design and have at their free end a portion of increased rigidity with makes threading in easier.

In the version illustrated in FIG. 3, the main difference is a vertically arranged roller 16, on which a narrow and a wide foil web 17 and 17' are wound. Between the roller 16 and the frame 2 are arranged a fixed foil-clamping rail 18 for the two foils 17 and 17' and a foil-severing knife 19, and on the upper crossbar of the frame 2 is arranged a displaceable foil-clamping rail 20.

The narrow foil web 17', which is a few centimetres wide, is laid onto the lower welding bar 3 (FIG. 1), and the wide foil web 17, which is approximately 0.8 to 1.2 meters wide, comes onto the warp-yarn layer at the top and is provided as a run-in part for the start of weaving. The displaceable clamping rail 20 is set so that the distance between it and the foil-severing knife 19 corresponds exactly to the foil length required for the respective warp width. The two foils 17 and 17' are drawn respectively from the roller 16 as far as the clamping rail 20, are then clamped by this and the fixed clamping rail 18 and are finally cut off with the severing knife 1.

The drive of the upper welding bar 4 takes place, as illustrated, via a single motor-driven spindle 9', the upper welding bar 4 being connected to the upper crossbar of the frame 2 via scissor-type joints. The control desk 6', not shown in FIG. 1, is drawn in on the side of the stand 1 on the right in the figure.

The device described can be used in an extremely flexible and versatile manner in view of its displaceability and vertical adjustability and the possibility of matching the length of the foils exactly to the respective warp width. There are no problems, with this device, in moving up to any textile machines, such as drawing-in machines, sizing machines or weaving machines, and executing there the operations described.

We claim:

1. Method for fixing ends of aligned yarns forming a warp-yarn layer wound in an ordered manner on a beam, comprising tensioning the yarns of the warp-yarn layer; positioning the warp-yarn layer between two plastic foil pieces with a portion of at least one of the plastic foil pieces projecting beyond the ends of the yarns forming the warp-yarn layer, and welding the yarns together with the two plastic foil pieces to fix the ends of the yams, the portion of the one plastic foil piece projecting beyond the ends of the yams providing a ran-in part for threading the warp yarn layer into a weaving machine.

2. Method according to claim 1, wherein the plastic foil pieces are made of polyethylene.

3. Method according to claim 1, wherein the welding step is carried out outside the weaving machine.

4. Method according to claim 3,. wherein the welding operation is carried out immediately after a drawing in operation or on a harness carriage.

5. Device for fixing ends of aligned yarns forming a yarn layer wound in an ordered manner on a beam, comprising:

a pair of welding bars, at least one of said welding bars being movable so that said welding bars are positionable with respect to one another at a rest position in which a gap is formed between the pair of welding bars to permit the yarn layer to be located between the welding bars and a working position in which the welding bars are positioned in close proximity to one another for fixing together the ends of the yarns through use of a plastic foil;

a rotatable brush beam for tensioning the yarns, said brush beam being movable in a vertical direction relative to the gap; and means for moving the brush beam in the vertical direction relative to the gap to lay the yarns of the yarn layer on one of the welding bars with a plastic foil piece interposed between the yarns and the one welding bar to permit fixing of the ends of the yarns when the welding bars are positioned in the working position with respect to one another.

6. Device according to claim 5, wherein the welding bars are carried on a vertically adjustable frame, being connected to said frame.

7. Device according to claim 6, wherein said brush beam is adapted to be lowered after the yarn layer has been laid onto the brush beam and after the brush beam has been rotated to tension the yarns.

8. Device according to claim 6, wherein the frame and the brush beam are mounted on a movable stand.

9. Device according to claim 8, wherein the stand includes a mounting for receiving a roller having the plastic foil.

10. Device according to claim 9, wherein the roller is arranged vertically, and the plastic foil is adapted to be drawn off from the roller in the direction of the longitudinal axis of the brush beam.

11. Device according to claim 10, including two plastic foil webs of differing width wound on the roller.

12. Device according to claim 11, including a fixed clamping rail arranged adjacent the roller and another clamping rail positioned adjacent the fixed clamping rail for clamping the plastic foil webs, said another clamping rail being adjustable in the longitudinal direction of the frame.

13. Device according to claim 12, including a severing knife for cutting off the plastic foil webs, said severing knife being arranged adjacent the fixed clamping rail.

14. Device according to claim 5, wherein each welding bar has a carrier with a supporting layer for a resistance wire and a covering foil covering the resistance wire.

15. Device according to claim 14, wherein the supporting layer and the covering foil are comprised of glass-fibre-reinforced polytetrafluoroethylene.

16. Device according to claim 14, wherein the resistance wire is comprised of a tungsten alloy.

17. Device according to claim 14, wherein the resistance wire is subjected to tensile stress in the longitudinal direction of the carrier and projects beyond the carrier.

18. Device according to claim 5, wherein one of said welding bars is fixed in position.

19. Method for fixing yarns in a yam layer that are wound in an ordered manner on a beam to maintain the yarns in the ordered manner, comprising tensioning the yarns of the yarn layer, the yam layer having oppositely disposed sides;

positioning a plastic foil piece on each side of the yam layer;

welding the plastic foil pieces together with the yarns of the yarn layer to fix the yarns and maintain the yams in an ordered manner, the plastic foil pieces being welded with only a single layer of textile material interposed between the plastic foil pieces, said single layer of textile material being said yarn layer.

20. Method according to claim 19, wherein said step of positioning a plastic foil piece on each side of the yam layer includes positioning a first plastic foil piece on one side of the yarn layer and positioning a second plastic foil piece on the other side of the yarn layer, the second plastic foil piece being larger than the first plastic foil piece and extending beyond ends of the yarns in the yarn layer so that after said welding step a free end portion of the second plastic foil piece extends beyond the ends of the yarns to provide a run-in part for threading the yarn layer into a weaving machine.

21. Method according to claim 19, wherein said step of tensioning includes laying the yarns in the yarn layer over a brush beam and rotating the brush beam.

22. Method according to claim 21, wherein said welding step includes positioning said yams in the yarn layer between two welding bars, and moving one of the welding bars toward the other welding bar until the two welding bars are positioned at a working position at which welding of the plastic foil pieces together with the yarns in the layer is effected.

23. Method according to claim 22, including after said yams of the yarn layer are tensioned by the brush beam, moving the brush beam to position the yarns on one of the plastic foil pieces.

* * * * *